US007226073B1

(12) United States Patent
Zahiri

(10) Patent No.: US 7,226,073 B1
(45) Date of Patent: Jun. 5, 2007

(54) LUGGAGE CART HAVING A TELESCOPING HANDLE WITH THE ADDITION OF A FOLDABLE SUPPORTIVE WHEEL ASSEMBLY

(76) Inventor: Hormoz Zahiri, 11718 Chenault St., Los Angeles, CA (US) 90049

( * ) Notice: Subject to any disclaimer, the term of this patent is extended or adjusted under 35 U.S.C. 154(b) by 0 days.

(21) Appl. No.: 11/350,971

(22) Filed: Feb. 8, 2006

(51) Int. Cl.
*A45C 5/14* (2006.01)

(52) U.S. Cl. ..... 280/655; 280/37; 280/47.2; 190/18 A; 190/115

(58) Field of Classification Search ..... 280/655, 280/37, 47.17, 47.315, 47.371, 47.2; 190/18 A, 190/115; 16/113.1
See application file for complete search history.

(56) References Cited

U.S. PATENT DOCUMENTS 4,630,837 A * 12/1986 Kazmark ..... 280/47.2
5,374,073 A * 12/1994 Hung-Hsin ..... 280/30
5,568,848 A * 10/1996 Liang ..... 190/18 A
5,984,326 A * 11/1999 Abraham et al. ..... 280/47.2
6,082,510 A * 7/2000 Liang ..... 190/18 A
6,182,981 B1 * 2/2001 Kuo ..... 280/37
6,279,705 B1 * 8/2001 Wu ..... 190/18 A
6,345,414 B1 * 2/2002 Chen ..... 16/113.1
6,401,888 B1 * 6/2002 Kuo ..... 190/18 A
6,446,987 B2 * 9/2002 Abraham et al. ..... 280/47.2
6,464,245 B1 10/2002 Miles
6,497,311 B2 * 12/2002 Tiramani et al. ..... 190/115
6,688,614 B2 * 2/2004 Hsu ..... 280/37
6,802,409 B1 * 10/2004 Tiramani et al. ..... 190/18 A
2001/0045715 A1 * 11/2001 Abraham et al. ..... 280/37
2002/0023813 A1 * 2/2002 Tiramani et al. ..... 190/115
2003/0042711 A1 * 3/2003 Hsu ..... 280/651
2005/0023096 A1 * 2/2005 Tiramani ..... 190/18 A

* cited by examiner

*Primary Examiner*—J. Allen Shriver
(74) *Attorney, Agent, or Firm*—Thomas I. Rozsa

(57) ABSTRACT

The present invention relates to a luggage cart with a telescoping handle and fixed wheels including the addition of a foldable supportive wheel structure which is incorporated within the telescoping handle of a conventional luggage cart with fixed wheels to reduce the load that is applied to a user when a conventional luggage cart is employed.

20 Claims, 5 Drawing Sheets

LUGGAGE CART HAVING A TELESCOPING HANDLE WITH THE ADDITION OF A FOLDABLE SUPPORTIVE WHEEL ASSEMBLY

BACKGROUND OF THE INVENTION

1. Field of the Invention

The present invention relates generally to a luggage cart having a telescoping handle and fixed wheels located at the bottom of the luggage cart.

2. Description of the Prior Art

Conventional luggage carts having telescoping handles and fixed wheels are well known for conveniently transporting personal items when the user is traveling. The carts reduce the burden of transporting the weight of the personal items during transportation. One example of a prior art luggage cart is disclosed in U.S. Pat. No. 5,951,037 to Hsich.

Physically, the reduction of the load of the weight of the luggage cart is governed by the principle of leverage. A level of comfort to enable reduction of the load that the user can achieve is dependent upon how the user applies the physical principles of leverage based on the physical condition and body height of the user.

It is also well known that achieving a level of comfort by using a conventional luggage cart is limited, since complete reduction of the load of the luggage weight is very difficult to achieve. This is due to that fact that complete reduction of the load to a user from the luggage weight can only be achieved when the telescoping handle is raised high enough so that a particular large angle is reached, which is defined by the luggage body relative to the ground. In that orientation, the center of gravity of the luggage weight is perpendicular above the center of the wheels. At this particular position, the law of leverage permits the user to have zero load from the luggage weight.

However, it is also well known that the particular position is physically very unstable since the position of center of gravity of the luggage weight is higher than that of a support point where the wheels contact the ground. In addition to the instability, it is also difficult for the user to pull the luggage cart in this orientation when there is the large angle relative to the pulling direction.

To compensate for and overcome such difficulties, the user usually will lower the telescoping handles in order to exchange stability as a tradeoff in order to make pulling the luggage cart easier. However, as a result, if the user has to travel a long distance with the luggage cart, the burden on the user will be increased. This problem will be worsened if the user is elderly or physically weak, or is carrying other items, or is carrying a baby.

Many inventors have tried to improve the comfort to users by utilizing a luggage cart. One such inventor is Miles. The Miles invention shown in U.S. Pat. No. 6,464,245 discloses an improvement in handle design by adding a secondary grip extension. However, the invention does not solve the problem disclosed above.

There is a significant need to significantly reduce the load of the luggage weight as a luggage cart is being pulled.

SUMMARY OF THE INVENTION

The present invention relates to a luggage cart with a telescoping handle and fixed wheels. More particularly, the present invention relates to an addition of a foldable supportive wheel structure which is incorporated within the telescoping handle of a conventional luggage cart with fixed wheels to reduce the load that is applied to a user when a conventional luggage cart is employed.

It has been known that the weight of luggage in the luggage cart is partially distributed to the user when the user holds the telescoping handle of the conventional luggage cart with the fixed wheels. This increases the burden on the user, especially if the user has to travel a long distance or is in poor physical condition, or is simultaneously carrying other items.

It has been discovered, according to the present invention, that the above identified difficult problem can be eliminated if an additional supportive wheel structure is incorporated within the telescoping handle structure of the luggage cart. Therefore, the weight of the luggage will be distributed between the fixed wheels and the additional supportive wheel structure. The user then can have the load significantly reduced, and comfortably pull the present invention luggage cart for travel regardless of the length of the time or distance that the luggage cart will need to be pulled.

It has further been discovered, according to the present invention, that if an additional supporting structure is incorporated into the telescoping assembly, which structure is retained within the cart when the cart is not in use, and which structure will unfold when the telescoping assembly is pulled out of its enclosure within the cart, then the additional wheel structure will create an additional supportive element so that instead of having just the two wheels at the end of the cart, the additional wheels which are incorporated into the present invention will further distribute the load on the luggage cart and enable the user to more easily pull the luggage cart.

It has also been discovered, according to the present invention, that if the assembly wheel structure is locked in place when it is placed within the enclosure, then after the assembly wheel structure is pulled out of its enclosure, the assembly wheel structure will not automatically fall down unless the release mechanism is first activated so that the release mechanism enables the wheels to fall into their operative condition. Therefore, through this additional innovation, the wheels would not accidentally fall down and possibly injure the user when the user is not expecting the wheels to come down after the telescoping handle is pulled out of its enclosure from the luggage cart.

It has also been discovered, according to the present invention, that if the wheel structure has ball bearing type rotatable wheels, it will more easily facilitate the rolling action on the ground when the additional wheel structure is in its useful condition.

It is therefore an object of the present invention to provide an additional supportive wheel structure which is incorporated within the telescoping handle structure of the luggage cart. Through this innovation, the weight of the luggage will be distributed between the fixed wheels and the additional supportive wheel structure. Therefore, it is an object of the present invention to have the load significantly reduced, and to enable the user to comfortably pull the present invention luggage cart for travel regardless of the length of time or distance that the luggage cart will need to be pulled.

It is a further object of the present invention to provide the additional supporting structure which is incorporated into the telescoping assembly, which structure is retained within the cart when the cart is not in use and which structure will unfold when the telescoping assembly is pulled out of its enclosure within the cart. This additional wheel structure will create an additional supportive element so that instead of having just two wheels at the end of the luggage cart, the additional wheel structures which are incorporated into the present invention will further distribute the load on the luggage cart and enable the user to more easily pull the luggage cart.

It is also an object of the present invention to provide the additional wheel assembly with a structure that is locked in place when it is within its enclosure within the cart. Then after the assembly wheel structure is pulled out of its enclosure, the assembly wheel structure will not automatically fall down unless the release mechanism of the locking structure is first activated so that the release mechanism enables the wheels to fall into their operative condition. Therefore, through this additional innovation, the wheels will not accidentally fall down and possibly injure a user when the user is not expecting the wheels to come down after the telescoping handle is pulled out of its enclosure from the luggage cart.

Further novel features and other objects of the present invention will become apparent from the following detailed description, discussion and the appended claims, taken in conjunction with the drawings.

BRIEF DESCRIPTION OF THE DRAWINGS

Referring particularly to the drawings for the purpose of illustration only and not limitation, there is illustrated.

DETAILED DESCRIPTION OF THE PREFERRED EMBODIMENTS

Although specific embodiments of the present invention will now be described with reference to the drawings, it should be understood that such embodiments are by way of example only and merely illustrative of but a small number of the many possible specific embodiments which can represent applications of the principles of the present invention. Various changes and modifications obvious to one skilled in the art to which the present invention pertains are deemed to be within the spirit, scope and contemplation of the present invention as further defined in the appended claims.

Referring to FIGS. 1 through 6, there is illustrated a luggage cart having an assembly of a telescoping handle with the addition of the present invention foldable supportive wheel structure.

Figure 1:
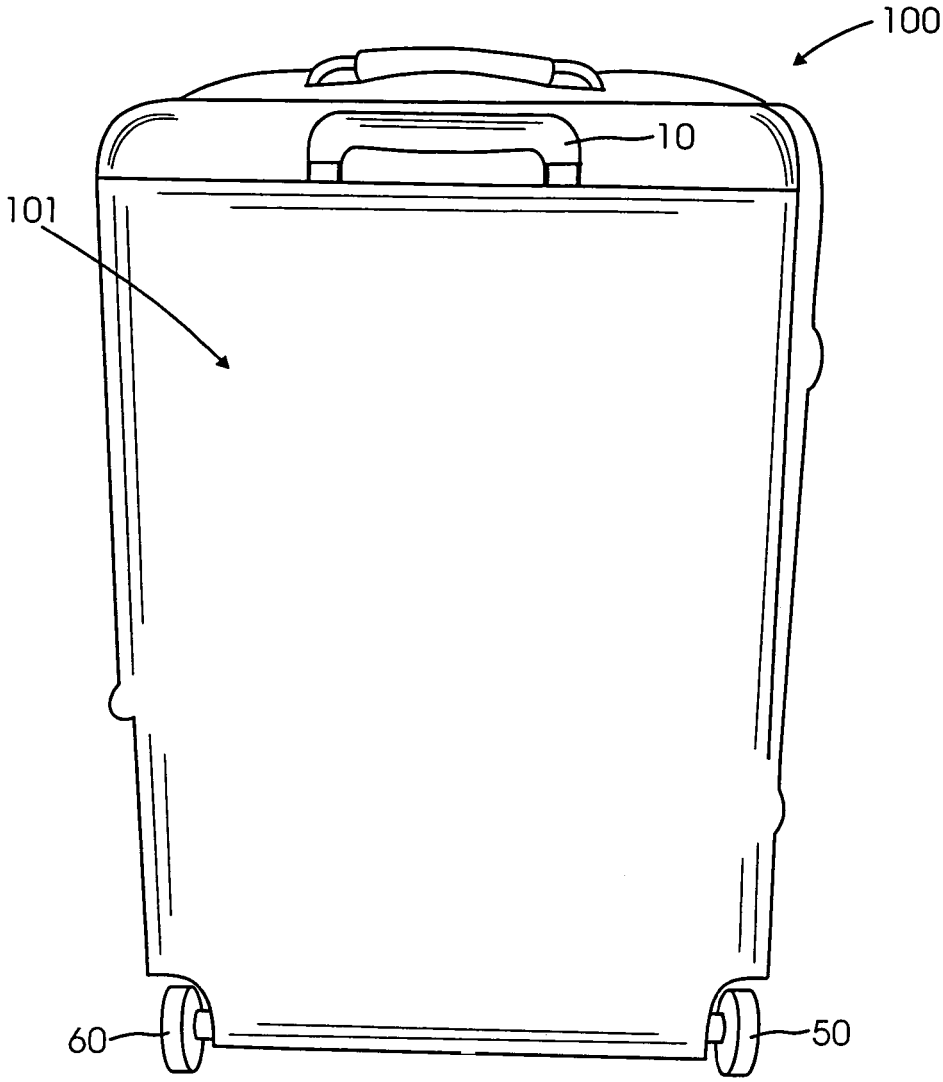
FIG. 1 is a rear elevational view of the present invention luggage cart having an assembly of a telescoping handle with the addition of the present invention foldable supportive wheel structure.

Referring to FIG. 1 there is illustrated the present invention as seen from the rear of the luggage cart 100 having the assembly of a telescoping handle with the addition of the present invention foldable supportive wheel structure. The rear 101 of the luggage cart and the top of the telescoping handle 10 of the assembly are shown and a pair of conventional main wheels 50 and 60 is also shown. The present invention is in its concealed condition within the luggage cart.

Figure 2:
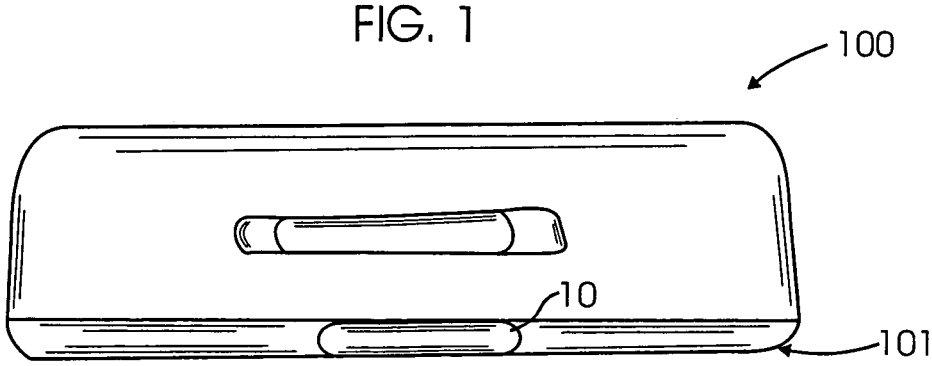
FIG. 2 is a top plan view of a luggage cart which incorporates the present invention.

Referring to FIG 2 there is illustrated a top plan view of a luggage cart with the present invention incorporated therein.

Figure 3:
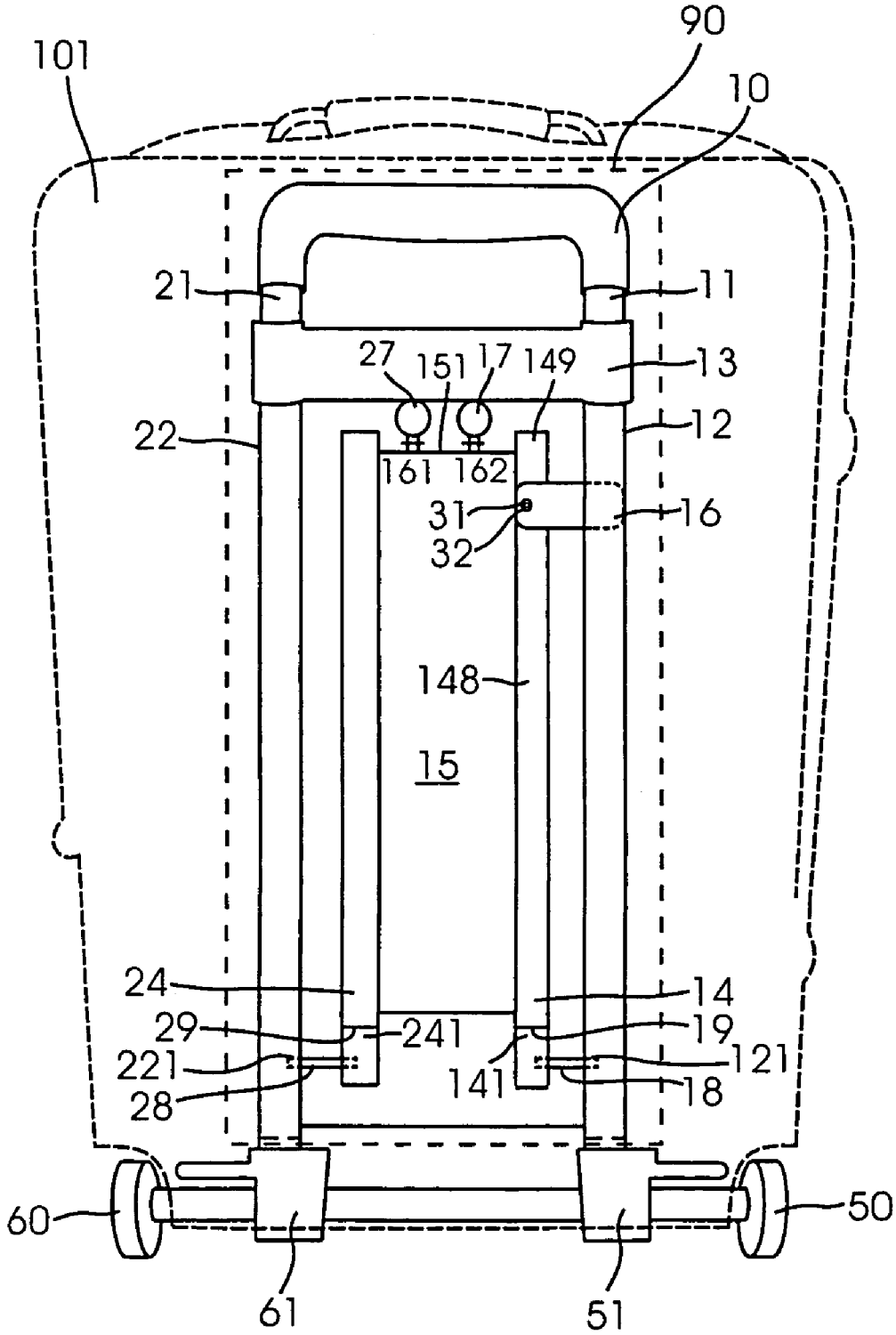
FIG. 3 is a rear elevational view of the detailed structure of a luggage cart having an assembly comprising a telescoping handle with the addition of the present invention foldable supportive wheel structure, where the telescoping handle is at its lower position within the luggage cart, with the luggage cart shown dotted lines.

As shown in FIG. 3, there is illustrated the present invention assembly 90 of the telescoping handle with the addition of a foldable supportive wheel structure. The main mechanism of the present invention is disclosed.

As shown in FIG. 3, the telescoping handle 10 is mechanically linked to a first handle rod 11 located at the right side of the handle 10 and a second handle rod 21 located at the left handle side of the handle 10. Said handle 10 and handle rods 11 and 21 form a "U" shape planar part which is parallel to a surface of the back side 101 of the luggage cart 100. Each respective right and left handle rod 11 and 21, respectively telescope onto a corresponding right handle rod housing 12 and left handle rod housing 22. Said right handle rod housing 12 is a long hollow structure to slidably receive the right first handle rod 11. Said right handle rod housing 12 includes a slot 121 opening into the hollow body of the right handle rod housing 12. The slot 121 opens inwardly and is parallel to the plane defined by the handle 10 and handle rods 11 and 21. Similarly, the left handle rod housing 22 is also a hollow structure to slidably receive the left second handle rod 21. The left handle rod housing 22 has a slot 221 located adjacent its lower end, the slot 221 opening into the body of the left handle rod 22. The slot 221 opens inwardly and is parallel to the plane defined by the handle 10 and handle rods 11 and 21. This structure is intended to illustrate only one possible embodiment. Numerous other telescoping embodiments are also with the spirit and scope of the present invention.

The respective lower end of the right and left handle rod housings 12 and 22 are respectively assembled into a luggage cart right side structure member 51 and left side structure member 61. Adjacent the upper ends of the right and left handle rod housing 12 and 22, a handle rod housing support 13 is used to fix the right handle rod housing 12 and left handle rod housing 22. The support 13 is perpendicularly connected to each handle rod housing 12 and 22 adjacent to the upper end position of said housings. Said support 13 is further connected to the frame structure of the luggage cart 100. Therefore, the right handle rod housing 12 and the left handle rod housing 22 are permanently fixed onto the frame of the luggage cart 100. The "U" shaped planar part comprising the telescoping handle 10 and the right and left handle rods 11 and 21 can be elevated to its opened condition by an upward pulling force. It can also be lowered to its concealed position by a downward pressing force.

Between said right handle rod housing 12 and left handle rod housing 22, there is an additional planar structure comprising a right foldable rod 14 and left foldable rod 24, which are mechanically and rigidly connected with an attachment plate 15 between them. Said right foldable rod 14 and left foldable rod 24 are parallel to said handle rods 11 and 21. A right pin 18 at its left end is permanently and perpendicularly affixed to the right foldable rod 14. An open end of said right pin 18 is inserted into said slot 121 of said right hand rod housing 12. Similarly, a left pin 28 is permanently and perpendicularly affixed to the left foldable rod 24. An open end of said pin 28 is inserted into said slot 221 of the left hand rod housing 22.

An advantage of having the right foldable rod 14, the left foldable rod 24, and the attachment plate 15 in the same plane is that the configuration reduces the thickness of the structure, which thereby minimizes the spaced occupied by the present invention. Alternatively, said rods 14 and 24 can be placed in a plane which is different from that of the attachment plate 15. In that situation, the structure will occupy more room than the structure which is planar.

The present invention also comprises a pair of foldable joint mechanisms 19 and 29 at the respective lower ends 141 and 241 of the right foldable rod 14, and the left foldable rod 24. By way of example, the foldable joint mechanisms 19 and 29 can be spring joint mechanisms. The spring mechanism can be locked at any desired angle within a range of desired angles. The locking can be achieved by a pin and ratchet mechanism or any other mechanism which is well known to achieve the result. The spring mechanism can be released from the locked position and moved to another locked angle or released and moved into its at rest position.

It is also within the spirit and scope of the present invention for the structure comprising components of 14, 24, 15, 18, 28, 19, and 29 to be replaced with any other comparable structure as long as that the structure has the same function, which enables it to be folded, attached to the handle rods, and moved along with the handle rod housings. In addition, instead of the two joint mechanisms disclosed above, it is also within the spirit and the scope of the present invention to have a single joint mechanism as long as it is capable of being folded inwardly in the plane of the handle rods when at rest and folded downwardly when in use.

As illustrated in FIG. 3, there is a release mechanism 16 located between the top 149 and the middle point 148 of the right foldable rod 14. The release mechanism may be a bar shaped device or can have any other shape which performs the desired function. The release mechanism 16 at its left end 161 is linked to the right foldable rod 14 with a hole-and pin structure where a hold 31 is on the release mechanism 16 and a pin 32 is fixed onto the right foldable rod 14. The pin 32 is perpendicular to the plane comprising from components 14, 24, and 15. Said hold-and-pin structure enables the release mechanism 16 rotate around the axle of the pin 32. The right end 162 of the release mechanism 16 is an open end, and is placed behind and touches the right handle rod housing 12 as illustrated in FIG. 3. The release mechanism 16 is illustrated at its locked position, which is set perpendicular to the right foldable rod 14 and the right handle rod housing 12. The release mechanism 16 can be rotated ninety (90) degrees when in the opened conditions so that it is set parallel to the right foldable rod 14 and right handle rod housing 12. When in the opened condition, the release mechanism 16 does not touch said right handle housing 12. Said released position of the release mechanism 16 is about 90 degree to said locked position of the mechanism.

It is within the spirit and scope of the present invention structure including said release mechanism 16 to be replaced with any other designed release mechanism as long as the designed release mechanism has the same function, which enables it to lock said structure when a free end of the designed release mechanism touches a part fixed to said luggage cart body, as well as which enables it to be moved to a released condition when the free end of designed release mechanism does not touch a part of the luggage cart body.

As further illustrated in FIG. 3, a pair of wheels, a right wheel 17 and a left wheel 27 are located at the upper end 151 of the attachment 15. Each of the wheels has a structure of two rotatable axes so that each wheel can be rotated freely around its respective vertical and horizontal axes. It is also within the spirit and scope of the present invention to embody an alternative design with only one wheel. The wheel can achieve the same function, which is to reduce the weight of the luggage load on the user when the luggage cart is pulled.

Figure 4:
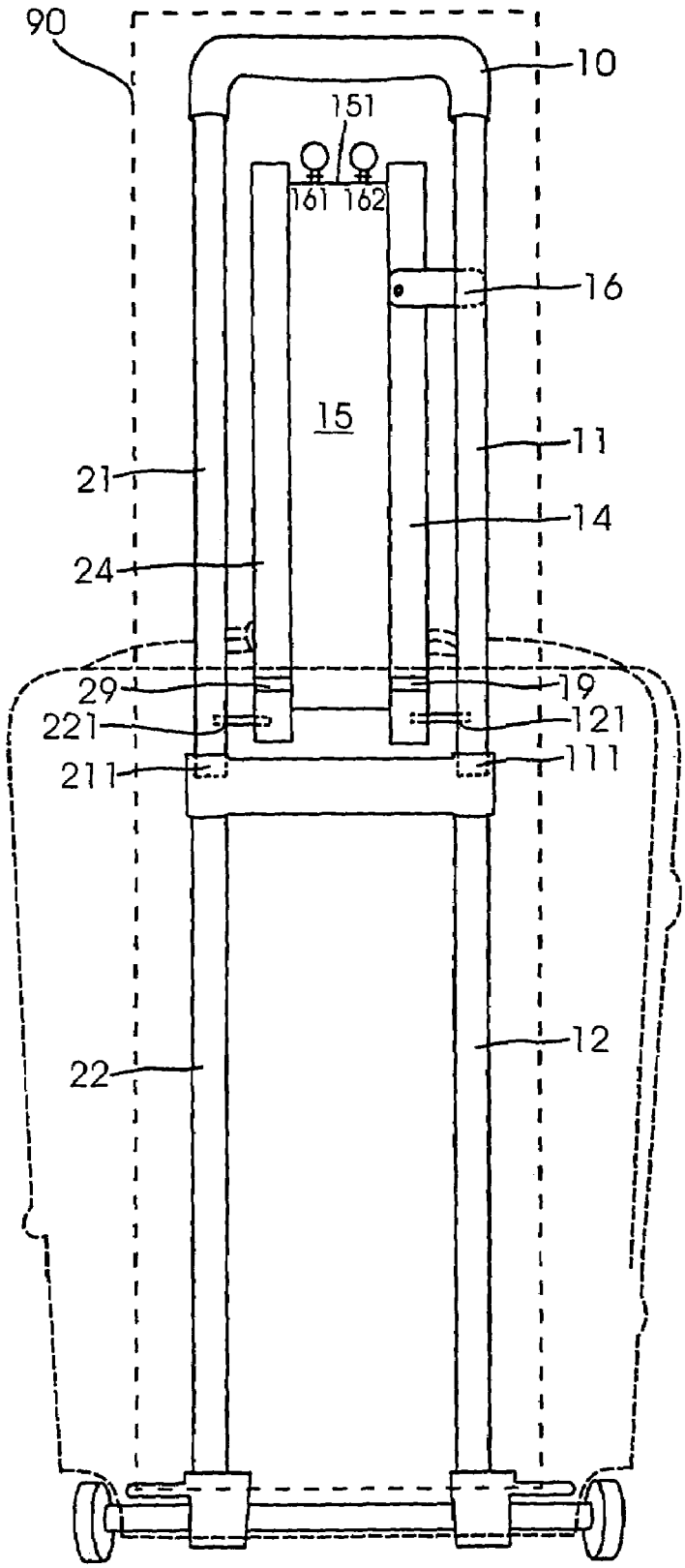
FIG. 4 is a rear elevational view of the detailed structure of a luggage cart having an assembly comprising a telescoping handle with the addition of the present invention foldable supportive wheel structure, where the telescoping handle is at its raised elevated position, with the luggage cart shown in dotted lines.

Referring FIG. 4, there is illustrated the present invention assembly having the telescoping handle with the addition of a foldable supportive wheel structure at its elevated position after it is pulled upward and out of its retaining chamber within the luggage cart. The lower ends 111 and 211 of the handle rods 11 and 21 respectively still remain inside of the top portion of the handle rod housing 12 and 22. The planar structure comprising the right foldable rod 14, the left foldable rod 24, and the attachment plate 15 is still at its locked position, which is parallel to the surface defined with the telescopic handle 10, right telescoping handle rod 11, and left telescoping handle rod 21. This is due to the fact that the release mechanism 16 provides support to prevent the planar structure comprising components 14, 24, and 15 from flipping or falling downward, possibly against the user.

Figure 5:
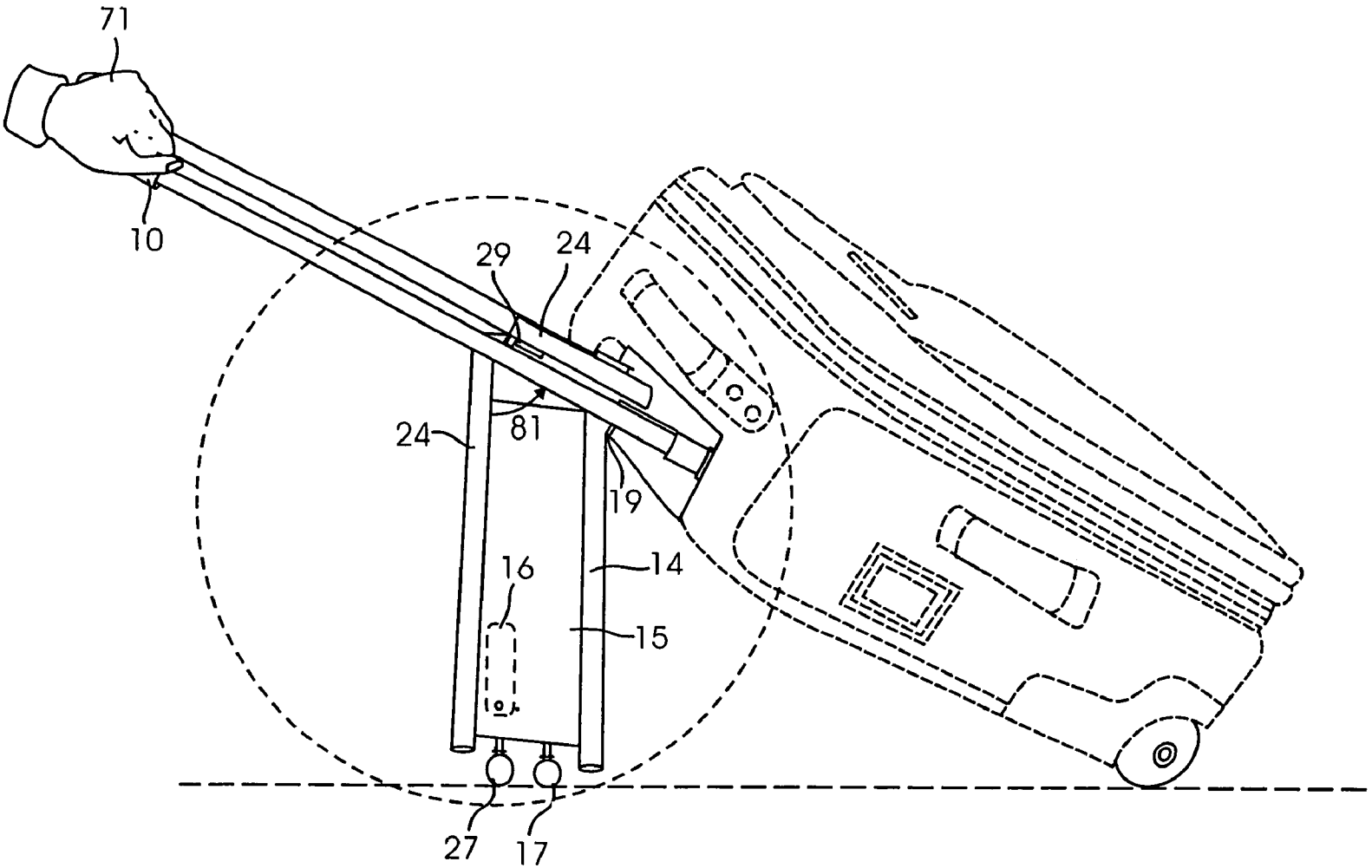
FIG. 5 is a perspective view of the present invention foldable supportive wheel structure in its operative condition when in use.

Referring FIG. 5, the present invention luggage cart having the assembly of a telescoping handle with the addition of a foldable supportive wheel structure is illustrated in its working state. As shown in the FIG. 5, the hand 71 of a person is pulling the luggage cart by holding the telescoping handle 10 when it is at its elevated position. The release mechanism 16 has been turned about 90 degrees by the user, from its locked position which is perpendicular to the foldable rods 14 and 24, to its released position which is parallel to said foldable rods, so that the planar structure comprising right foldable rod 14 and left foldable rod 24, and attachment plate 15 has been released and rotated downward by the user to pull said structure into its operating position, where one pair of wheels 17 and 27 touches the ground.

As previously described, the foldable joint mechanisms 19 and 29 can be locked to an appropriate angle by pressing or pulling forces applied to said mechanisms by the user. With the function of said foldable joint mechanisms, the planar structure comprising said foldable rods 14 and 24 and attachment 15 plate keeps an appropriate angle to the plane defined by the right handle rod housing 12, left handle rod housing 22, and the housing support 13. The present invention luggage cart having the assembly with the addition of the present invention foldable supportive wheel structure enables the user to comfortably pull the luggage cart 100 forward when the planar structure comprising items 14, 24, 15, 17, and 27 supports part of the weight of the luggage. In addition, the wheels 17 and 27 ergonomically facilitate easier movement of the luggage cart.

Figure 6:
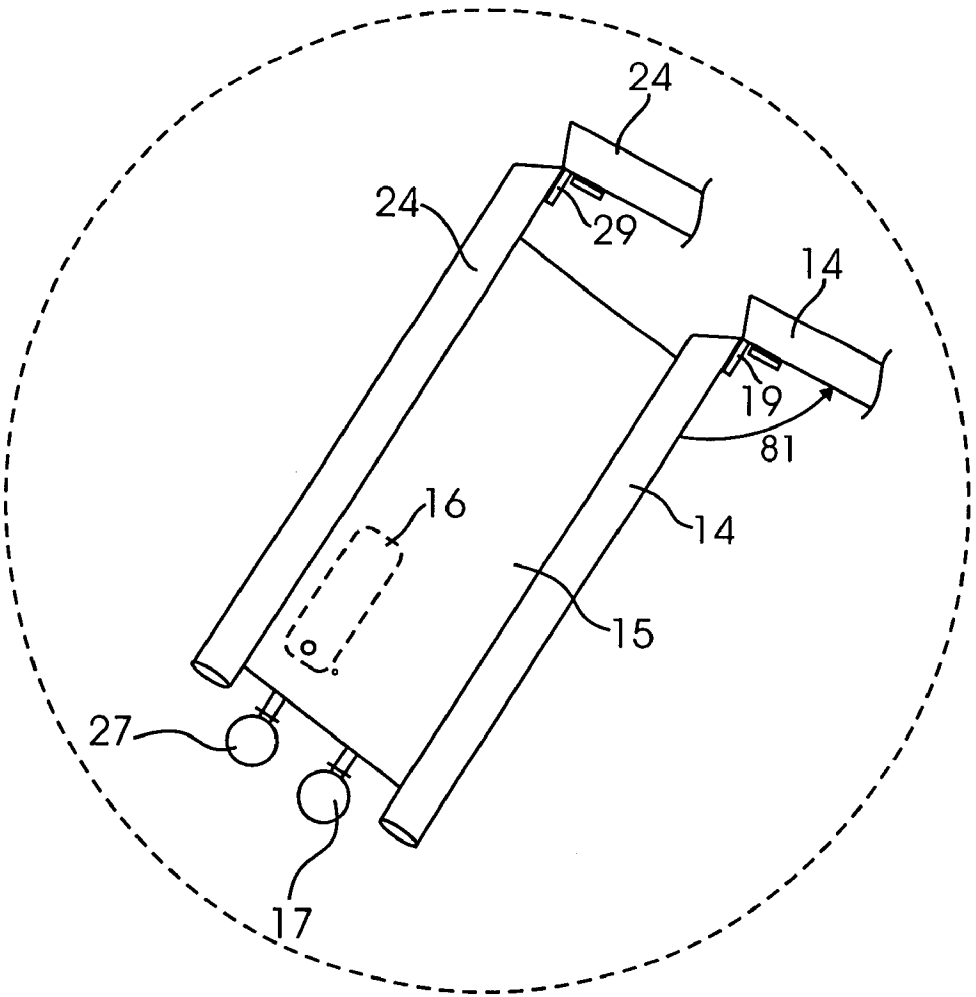
FIG. 6 is a detailed illustration of the working position of the present invention foldable wheel structure.

FIG. 6 illustrates a detailed view of the working position of the present invention foldable wheel structure. The foldable rods 14 and 24 are at their folded position which keeps an angle that is determined by the user through operating the foldable joint mechanisms 19 and 29. The wheels 17 and 27 are touching the ground. The release mechanism is at its released position.

As an example to illustrate the present invention, a luggage cart 100 having an assembly of a telescoping 10 handle with the addition of the present invention foldable supportive wheel structure can have a luggage body measuring 19"×14"×10". The luggage cart can be designed to have a separate compartment for the assembly 90. The telescoping handle 10 can be 6" in width. The physical length from the foldable rod at the position of the pin 18 to the wheel 17 can be 17". The angle 81 as illustrated can be controlled by the foldable joint mechanisms between 30 to 60 degrees. The foldable joint mechanisms 19 and 29 can be spring joint mechanisms, which can be locked and released at an appropriate angle between a preferred range of 30 to 60 degrees. It is also within the spirit and scope of the present invention for the joints to be any other joint mechanisms as long as the joint mechanisms can be locked and released at a particular angle within a desired range of angles. The attachment 15 can be simply a plate, or a sheet of metal bent to be a box. The main wheels 50 and 60 can have a diameter of 3". The pair of additional wheels can each have a wheel diameter of 1.5" and can be installed at the end of the plate or the box. In addition, if desired, the angle disclosed above can be greater than 60 degrees, which is also within the spirit and scope of the present invention, as long as the invented structure when in use is able to touch the ground.

Defined in detail, the present invention is a luggage cart having a main body with an interior chamber which receives a handle assembly having a telescoping handle connected to a pair of parallel spaced apart telescoping handle rods each respectively received within a hollow chamber of a respective handle rod housing, the handle rod housings set within the interior chamber and the handle movable from a closed position where the handle rods are within their respective handle rod housings to an opened position where the handle is pulled out so that the handle rods are extended from their respective handle rod housings, the main body having a pair of oppositely disposed main wheels located adjacent to one end, the invention comprising: (a) a planar structure positioned between the handle rod housings and having a right foldable rod and a parallel left foldable rod, each foldable rod having a transverse pin adjacent one end which is received within a corresponding slot located in a respective handle rod housing so that the respective pins can move within a respective slot, the right and left foldable rods connected by an attachment member, the planar structure movable with the movement of the handle; (b) the left and right foldable rods each having a foldable joint mechanism located adjacent the area of their respective pins, the foldable joint mechanisms enabling each foldable rod to be rotated into two sections with an elongated section rotatable at a desired angle relative to the other section of the foldable rod; (c) a release mechanism located on one of the foldable rods at a location remote from the movable joint mechanism, the release mechanism being a bar shaped device which is rotatably mounted to the foldable rod and movable to a closed position where it is locked against an adjacent handle rod so that the planar structure is fixed between the two handle rods and rotatable to an opened condition wherein the planar structure can rotate about the foldable joint mechanisms; and (d) a pair of wheels located on said attachment member at a location remote from said foldable joint mechanisms; (e) whereby, when said handle and handle rods are pulled out of the handle rod housings, said planar structure travels with said handle, and when said release mechanism is rotated on its opened condition, said planar structure is rotated by a given angle so that the wheels attached to the attachment member touch the ground while the planar structure is at an angle relative to the handle rods so that as the luggage cart is pulled, the two additional wheels on the attachment member provide additional support and facilitate movement of the luggage cart.

Defined broadly, the present invention is a luggage cart having a main body with includes means to support a handle assembly having a telescoping handle connected to a pair of parallel spaced apart telescoping handle rods each respectively received within a hollow chamber of a respective handle rod housing, the handle rod housings supported on the luggage cart, the handle movable from a closed position where the handle rods are within their respective handle rod housings to an opened position where the handle is pulled out so that the handle rods are extended from their respective handle rod housings, the main body having a pair of oppositely disposed main wheels located adjacent to one end, the invention comprising: (a) a planar structure positioned between the handle rod housings and having a right foldable rod and a parallel left foldable rod, each foldable rod having a means adjacent one end by which the foldable rod is rotatably supported on an adjacent handle rod housing, the right and left foldable rods connected by an attachment member, the planar structure movable with the movement of the handle; (b) the left and right foldable rods each having a foldable joint mechanism which enables each foldable rod to be rotated into two sections with an elongated section rotatable at a desired angle relative to the outer section of the foldable rod; (c) a release mechanism located on one of the foldable rods at a location remote from the movable joint mechanism, the release mechanism rotatably mounted to a foldable rod and movable to a closed position where it is locked against an adjacent handle rod so that the planar structure is fixed between the two handle rods and rotatable to an opened condition wherein the planar structure can rotate about the foldable joint mechanisms; and (d) a pair of wheels located on said attachment member at a location remote from said foldable joint mechanisms; (e) whereby, when said handle and handle rods are pulled out of the handle rod housings, said planar structure travels with said handle, and when said release mechanism is rotated to its opened condition, said planar structure is rotated by a given angle so that the wheels attached to the attachment member touch the ground while the planar structure is at an angle relative to the handle rods so that as the luggage cart is pulled, the two additional wheels on the attachment member provide additional support and facilitate movement of the luggage cart.

Defined more broadly, the present invention is a luggage cart having a main body with includes means to support a handle assembly having a telescoping handle connected to a pair of parallel spaced apart telescoping handle rods each respectively received within a hollow chamber of a respective handle rod housing, the handle rod housings supported on the luggage cart, the handle movable from a closed position where the handle rods are within their respective handle rod housings to an opened position where the handle is pulled out so that the handle rods are extended from their respective handle rod housings, the main body having a pair of oppositely disposed main wheels located adjacent to one end, the invention comprising: (a) a planar structure positioned between the handle rod housings and rotatably connected to the handle rod housings, the planar structure movable with the movement of the handle; (b) the planar structure having at least one foldable joint mechanism which enables the planar structure to be rotatable to a desired angle relative to the handle rods; (c) a release mechanism located on the planar structure and movable to a closed position where the planar structure is locked against an adjacent handle rod so that the planar structure is fixed between the two handle rods and movable to an opened condition wherein the planar structure can rotate about the at least one foldable joint mechanism; and (d) at least one wheel wheels located on said planar structure a location remote from said at least one foldable joint mechanism; (e) whereby, when said handle and handle rods are pulled out of the handle rod housings, said planar structure travels with said handle, and when said release mechanism is moved to its opened condition, said planar structure is rotated by a given angle so that the at least one wheel attached to the planar structure touches the ground while the planar structure is at an angle relative to the handle rods so that as the luggage cart is pulled, the at least one wheel on the planar structure provides additional support and facilitate movement of the luggage cart.

Of course the present invention is not intended to be restricted to any particular form or arrangement, or any specific embodiment, or any specific use, disclosed herein, since the same may be modified in various particulars or relations without departing from the spirit or scope of the claimed invention hereinabove shown and described of which the apparatus or method shown is intended only for illustration and disclosure of an operative embodiment and not to show all of the various forms or modifications in which this invention might be embodied or operated.

What is claimed is:

1. A luggage cart having a main body with an interior chamber which receives a handle assembly having a telescoping handle connected to a pair of parallel spaced apart telescoping handle rods each respectively received within a hollow chamber of a respective handle rod housing, the handle rod housings set within the interior chamber and the handle movable from a closed position where the handle rods are within their respective handle rod housings to an opened position where the handle is pulled out so that the handle rods are extended from their respective handle rod housings, the main body having a pair of oppositely disposed main wheels located adjacent to one end, the invention comprising:

a. a planar structure positioned between the handle rod housings and having a right foldable rod and a parallel left foldable rod, each foldable rod having a transverse pin adjacent one end which is received within a corresponding slot located in a respective handle rod housing so that the respective pins can move within a respective slot, the right and left foldable rods connected by an attachment member, the planar structure movable with the movement of the handle;

b. the left and right foldable rods each having a foldable joint mechanism located adjacent the area of their respective pins, the foldable joint mechanisms enabling each foldable rod to be rotated into two sections with an elongated section rotatable at a desired angle relative to the other section of the foldable rod;

c. a release mechanism located on one of the foldable rods at a location remote from the movable joint mechanism, the release mechanism being a bar shaped device which is rotatably mounted to the foldable rod and movable to a closed position where it is locked against an adjacent handle rod so that the planar structure is fixed between the two handle rods and rotatable to an opened condition wherein the planar structure can rotate about the foldable joint mechanisms; and d. a pair of wheels located on said attachment member at a location remote from said foldable joint mechanisms;

e. whereby, when said handle and handle rods are pulled out of the handle rod housings, said planar structure travels with said handle, and when said release mechanism is rotated to its opened condition, said planar structure is rotated by a given angle so that the wheels attached to the attachment member touch the ground while the planar structure is at an angle relative to the handle rods so that as the luggage cart is pulled, the two additional wheels on the attachment member provide additional support and facilitate movement of the luggage cart.

2. The luggage cart in accordance with claim 1 wherein said attachment member and said two handle rods are in the same plane.

3. The luggage cart in accordance with claim 1 wherein said attachment member is in a different plane from said handle rods.

4. The luggage cart in accordance with claim 1 wherein said attachment member is a plate.

5. The luggage cart in accordance with claim 1 wherein said attachment member is a box structure made of sheet metal.

6. The luggage cart in accordance with claim 1 wherein when in the desired angle of the foldable rods is between 30 degrees and 60 degrees.

7. The luggage cart in accordance with claim 1 wherein said foldable joint mechanisms further comprise spring joint mechanisms.

8. The luggage cart in accordance with claim 1 wherein said wheels on said attachment member are universal wheels which can rotate in any direction.

9. A luggage cart having a main body with includes means to support a handle assembly having a telescoping handle connected to a pair of parallel spaced apart telescoping handle rods each respectively received within a hollow chamber of a respective handle rod housing, the handle rod housings supported on the luggage cart, the handle movable from a closed position where the handle rods are within their respective handle rod housings to an opened position where the handle is pulled out so that the handle rods are extended from their respective handle rod housings, the main body having a pair of oppositely disposed main wheels located adjacent to one end, the invention comprising:

a. a planar structure positioned between the handle rod housings and having a right foldable rod and a parallel left foldable rod, each foldable rod having a means adjacent one end by which the foldable rod is rotatably supported on an adjacent handle rod housing, the right and left foldable rods connected by an attachment member, the planar structure movable with the movement of the handle;

b. the left and right foldable rods each having a foldable joint mechanism which enables each foldable rod to be rotated into two sections with an elongated section rotatable at a desired angle relative to the other section of the foldable rod;

c. a release mechanism located on one of the foldable rods at a location remote from the movable joint mechanism, the release mechanism rotatably mounted to a foldable rod and movable to a closed position where it is locked against an adjacent handle rod so that the planar structure is fixed between the two handle rods and rotatable to an opened condition wherein the planar structure can rotate about the foldable joint mechanisms; and d. a pair of wheels located on said attachment member at a location remote from said foldable joint mechanisms;

e. whereby, when said handle and handle rods are pulled out of the handle rod housings, said planar structure travels with said handle, and when said release mechanism is rotated to its opened condition, said planar structure is rotated by a given angle so that the wheels attached to the attachment member touch the ground while the planar structure is at an angle relative to the handle rods so that as the luggage cart is pulled, the two additional wheels on the attachment member provide additional support and facilitate movement of the luggage cart.

10. The luggage cart in accordance with claim 9 wherein said attachment member and said two handle rods are in the same plane.

11. The luggage cart in accordance with claim 9 wherein said attachment member is in a different plane from said handle rods.

12. The luggage cart in accordance with claim 9 wherein said attachment member is a plate.

13. The luggage cart in accordance with claim 9 wherein said attachment member is a box structure made of sheet metal.

14. The luggage cart in accordance with claim 9 wherein when in the desired angle of the foldable rods in between 30 degrees and 60 degrees.

15. The luggage cart in accordance with claim 9 wherein said foldable joint mechanisms further comprise spring joint mechanisms.

16. The luggage cart in accordance with claim 9 wherein said wheels on said attachment member are universal wheels which can rotate in any direction.

17. A luggage cart having a main body with includes means to support a handle assembly having a telescoping handle connected to a pair of parallel spaced apart telescoping handle rods each respectively received within a hollow chamber of a respective handle rod housing, the handle rod housings supported on the luggage cart, the handle movable from a closed position where the handle rods are within their respective handle rod housings to an opened position where the handle is pulled out so that the handle rods are extended from their respective handle rod housings, the main body having a pair of oppositely disposed main wheels located adjacent to one end, the invention comprising:

a. a planar structure positioned between the handle rod housings and rotatably connected to the handle rod housings, the planar structure movable with the movement of the handle;

b. the planar structure having at least one foldable joint mechanism which enables the planar structure to be rotatable to a desired angle relative to the handle rods;

c. a relase mechanism located on the planar structure and movable to a closed position where the planar structure is locked against an adjacent handle rod so that the planar structure is fixed between the two handle rods and movable to an opened condition wherein the planar structure can rotate about the at least one foldable joint mechanism; and d. at least one wheel wheels located on said planar structure a location remote from said at least one foldable joint mechanism;

e. whereby, when said handle and handle rods are pulled out of the handle rod housings, said planar structure travels with said handle, and when said release mechanism is moved to its opened condition, said planar structure is rotated by a given angle so that the at least one wheel attached to the planar structure touches the ground while the planar structure is at an angle relative to the handle rods so that as the luggage cart is pulled, the at least one wheel on the planar structure provides additional support and facilitate movement of the luggage cart.

18. The luggage cart in accordance with claim 17 wherein when in the desired angle of the planar structure is between 30 degrees and 60 degrees.

19. The luggage cart in accordance with claim 17 wherein said at least one foldable joint mechanism further comprises a spring joint mechanism.

20. The luggage cart in accordance with claim 17 wherein sat at least one wheel on said planar structure is a universal wheel which can rotate in any direction.

* * * * *